US011193643B2

(12) United States Patent
Kemetmüller et al.

(10) Patent No.: US 11,193,643 B2
(45) Date of Patent: Dec. 7, 2021

(54) LIGHT MODULE FOR A MOTOR VEHICLE HEADLAMP

(71) Applicant: ZKW Group GmbH, Wieselburg (AT)

(72) Inventors: Matthias Kemetmüller, Vienna (AT); Bernhard Mandl, Ober-Grafendorf (AT); Andreas Moser, Perg (AT); Friedrich Bauer, Bergland (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/048,004

(22) PCT Filed: May 14, 2019

(86) PCT No.: PCT/EP2019/062255

§ 371 (c)(1),
(2) Date: Oct. 15, 2020

(87) PCT Pub. No.: WO2019/224041

PCT Pub. Date: Nov. 28, 2019

(65) Prior Publication Data

US 2021/0108773 A1 Apr. 15, 2021

(30) Foreign Application Priority Data

May 25, 2018 (EP) ..... 18174282

(51) Int. Cl.
*F21S 41/25* (2018.01)
*F21S 41/141* (2018.01)
*F21Y 115/10* (2016.01)

(52) U.S. Cl.
CPC ..... *F21S 41/25* (2018.01); *F21S 41/141* (2018.01); *F21Y 2115/10* (2016.08)

(58) Field of Classification Search
None
See application file for complete search history.

(56) References Cited

U.S. PATENT DOCUMENTS

2010/0226142 A1 9/2010 Brendle et al.
2014/0092619 A1 4/2014 Bushre
(Continued)

FOREIGN PATENT DOCUMENTS

CN 206592963 U 10/2017

OTHER PUBLICATIONS

International Search Report for PCT/EP2019/062255, dated Aug. 22, 2019 (2 pages).
(Continued)

*Primary Examiner* — Elmito Breval
(74) *Attorney, Agent, or Firm* — Eversheds Sutherland (US) LLP

(57) ABSTRACT

The invention relates to a light module for a motor vehicle headlamp, comprising: at least one light source (1) and at least one projection device (2), the projection device (2) having an entry optical unit (21) and an exit optical unit (22), the entry optical unit (21) being designed to form an intermediate image from light emitted by the at least one light source (1) in an intermediate image plane, which lies between the entry optical unit (21) and the exit optical unit (22) and is substantially perpendicular to an optical axis of the projection device (2), and the exit optical unit (22) being designed to image the intermediate image into a region in front of the light module in the form of a light distribution of a first predefined type, at least one additional light source (3*a*, 3*b*, 3*c*, 3*d*) being provided, which at least one additional light source (3*a*, 3*b*, 3*c*, 3*d*) is designed to emit light between the entry optical unit (21) and the exit optical unit (22); the exit optical unit (22) being designed to image the light emitted by the at least one additional light source (3*a*, 3*b*, 3*c*, 3*d*) into the region in front of the light module in the form of a light distribution of a second predefined type; the entry optical unit (21) and the at least one additional light source
(Continued)

(3*a,* 3*b,* 3*c,* 3*d*) being designed in such a way and being associated with each other in such a way that neither the at least one additional light source (3*a,* 3*b,* 3*c,* 3*d*) nor the light emitted by the at least one additional light source (3*a,* 3*b,* 3*c,* 3*d*) changes the intermediate image.

19 Claims, 8 Drawing Sheets

(56) References Cited

U.S. PATENT DOCUMENTS

| | | | |
|---|---|---|---|
| 2016/0265733 | A1 | 9/2016 | Bauer et al. |
| 2017/0284621 | A1 | 10/2017 | Na et al. |
| 2017/0350568 | A1 | 12/2017 | Hager et al. |
| 2019/0186708 | A1 | 6/2019 | Ecker-Endl |

OTHER PUBLICATIONS

Search Report for European Patent Application No. 18174282, dated Sep. 20, 2018 (1 page).

LIGHT MODULE FOR A MOTOR VEHICLE HEADLAMP

The invention relates to a light module for a motor vehicle headlamp for the (preferably simultaneous) implementation of at least one primary and at least one secondary light function, comprising at least one light source and at least one projection device, wherein the projection device has an entry optical unit and an exit optical unit, wherein the entry optical unit is adapted so as to form an intermediate image from light emitted by the at least one light source in an intermediate image plane, lying between the entry optical unit and the exit optical unit, and substantially transverse to an optical axis of the projection device, and the exit optical unit is adapted so as to image the intermediate image in the form of a light distribution of a first predefined type into a region in front of the light module.

The invention furthermore relates to a motor vehicle headlamp with at least one such light module.

Light modules of the type cited above are of known art from the prior art. The international application of the applicant WO 2015/058227 Al shows a micro-projection light module for a motor vehicle headlamp, comprising at least one light source and at least one projection device, which images the light emitted from the at least one light source into a region in front of the motor vehicle in the form of at least one light distribution, wherein the projection device comprises: an entry optical unit, which consists of an array of micro-entry optical units, an exit optical unit, which consists of an array of micro-exit optical units, wherein exactly one micro-exit optical unit is associated with each micro-entry optical unit, wherein the micro-entry optical units are adapted such that, and/or the micro-entry optical units and the micro-exit optical units are arranged relative to each other such that, the light emitted from a micro-entry optical unit enters exactly into just the associated micro-exit optical unit, and wherein the light pre-shaped by the micro-entry optical units is imaged by the micro-exit optical units into a region in front of the motor vehicle as at least one light distribution.

The theme of the applicant's international application WO 2017/066817 A1 is that of a micro-projection light module for a vehicle headlamp, which comprises at least one light source and at least one projection device, which images the light emitted by the at least one light source into a region in front of the motor vehicle in the form of at least one light distribution, wherein the projection device has an entry optical unit, which has one, two or more micro-entry optical units, which are preferably arranged in an array, and an exit optical unit, which has one, two or more micro-exit optical units, which are preferably arranged in an array, wherein exactly one micro-exit optical unit is associated with each micro-entry optic, wherein the micro-entry optical units are adapted such that, and/or the micro-entry optical units and the micro-exit optical units are arranged relative to each other such that, substantially all the light emitted from a micro-entry optical unit enters exactly into just the associated micro-exit optical unit, and wherein the light pre-shaped by the micro-entry optical units is imaged by the micro-exit optical units in a region in front of the motor vehicle as at least one light distribution.

Furthermore, the applicant's international application WO 2017/066818 A1 shows a micro-projection light module for a motor vehicle headlamp, comprising at least one light source and at least one projection device, which images the light emitted by the at least one light source into a region in front of the motor vehicle in the form of at least one light distribution, wherein the projection device comprises an entry optical unit comprising one, two or more micro-entry optical units, preferably arranged in an array, an exit optical unit comprising one, two or more micro-exit optical units, preferably arranged in an array, wherein exactly one micro-exit optical unit is associated with each micro-entry optic, wherein the micro-entry optical units are adapted such that, and/or the micro-entry optical units and the micro-exit optical units are arranged relative to each other such that, substantially all the light emitted from a micro-entry optical unit enters exactly into just the associated micro-exit optical unit, and wherein the light pre-shaped by the micro-entry optical units is imaged by the micro-exit optical units into a region in front of the motor vehicle as at least one light distribution, wherein a first screening device is arranged between the entry optical units and the exit optical units.

A disadvantage of the above-cited light modules is that only a very limited number of light distributions can be generated, and consequently only a very limited number of light functions can be implemented with a single light module (low efficiency). Above all it is disadvantageous that such light modules do not offer the possibility of implementing a secondary light function, such as direction indication (static or dynamic, for example as a running light), position light and/or daytime running light (static or as a running light) etc., and a primary light function, such as dipped beam, main beam, light functions of an adaptive front lighting system (light functions of an AFS headlamp) from the same light-emitting surface of the light module.

The object of the present invention is accordingly to improve the conventional light modules, or to extend their composition, such that a plurality of light functions can be generated, preferably simultaneously, from the light-emitting surface of the same light module.

The object is achieved with a light module of the above-cited type by the provision of at least one other light source—a so-called additional light source—which at least one additional light source is adapted so as to emit light between the entry optical unit and the exit optical unit (in this region the at least one additional light source emits light); the exit optical unit is adapted so as to image the light emitted by the at least one additional light source into the region in front of the light module in the form of a light distribution of a second predefined type; the entry optical unit and the at least one additional light source are adapted and associated with each other such that neither the at least one additional light source nor the light emitted by the at least one additional light source changes the intermediate image.

Here the light generated by the at least one additional light source does not influence the intermediate image generated with the light of the at least one light source. The at least one additional light source preferably generates an additional/second intermediate image in the intermediate image plane, which image does not overlap the (original) intermediate image (generated with the light of the at least one light source).

It is conceivable for a collimator to be mounted downstream of the at least one light source.

This makes it possible, for example, to ensure that the light distribution of the first predefined type does not overlap the light distribution of the second predefined type in the light image, even though these are emitted from the same light-emitting surface of the light module. Such light distributions can be used to implement different light functions.

For example, the entry optical unit and the at least one additional light source can be adapted and associated with each other such that the light generated by the at least one light source passes through the optical projection device in accordance with (or along) a first beam path, and the light generated by the at least one additional light source passes through in accordance with a second, different beam path. Here it is expedient if the at least one additional light source is external to the first beam path—that is to say, it is not in the first beam path—so that neither the at least one additional light source, nor the light emitted by the at least one additional light source, changes the intermediate image.

It may be provided that the at least one additional light source is adapted to generate collimated light that is substantially parallel to the optical axis of the projection device. This has the advantage that, with regard to a light image generated with the at least one additional light source, an exact position of the at least one additional light source between the entry optical unit and the exit optical unit and, in particular, with regard to the intermediate image plane, is not relevant, which makes it easier to adjust the light module. It can in fact be advantageous if the at least one additional light source is not arranged in the intermediate image plane.

Further advantages ensue if the entry optical unit and the exit optical unit are arranged as matrix-like arrays of micro-entry optical units and micro-exit optical units—as a micro-entry optical unit array and a micro-exit optical unit array, respectively—arranged in planes standing transverse to the optical axis of the optical projection device, wherein at least one, preferably exactly one, micro-exit optical unit corresponds to each micro-entry optical unit such that they have a common optical axis, preferably extending horizontally, and form a micro-optical system.

In the context of the present invention, the term "common optical axis of two optical units" is to be understood to mean that the optical axes of these two optical units are substantially coincident.

The use of very small optical units on the light-emitting surface—micro-optical units with characteristic sizes in the micron range—leads to a more uniform visual appearance of the light-emitting surface in both the non-illuminated and also the illuminated state.

Furthermore, it may be provided that the at least one additional light source comprises a plurality of light-emitting regions, spaced apart from each other, for purposes of emitting the light between the entry optical unit and the exit optical unit, which light emission regions are arranged in a plane substantially transverse to the optical axis of the projection device—in the so-called light emission plane. It is to be understood that this plane is arranged between the entry optical unit and the exit optical unit. A light beam is preferably generated with the aid of each light-emitting region, which beam propagates parallel to the optical axis of the projection device.

In addition, it may be provided that the at least one additional light source comprises a light guide element, and an illuminant associated with the light guide element, preferably an LED illuminant, wherein the light-emitting regions are arranged in the light guide element. Here it can be advantageous if the illuminant does not lie between the entry optical unit and the exit optical unit. In a tried and tested form of embodiment, provision can be made for the illuminant and the at least one light source to be arranged on a common light source support. For example, if the at least one light source and the illuminant comprise LED light sources, these LED light sources can be arranged on a common circuit board (on the same print).

Furthermore, it may be provided that the light guide element comprises a light guide panel, arranged substantially transverse to the optical axis of the projection device, wherein the light guide panel has at least one light incoupling surface for purposes of coupling in light from the illuminant, which light propagates in the light guide panel and is emitted from the light guide panel in the light-emitting regions. It is of known art that the propagation of light within a light guide occurs by virtue of total reflection. The light of the illuminant can be coupled into the light guide panel from the side, or from below, or from above. After the incoupling, the light propagates (by virtue of total reflection) in the direction of the region between the entry optical unit and the exit optical unit. In the region between the entry optical unit and the exit optical unit, the light in the light guide panel propagates substantially transverse to the optical axis of the projection device until it is deflected into the light-emitting regions and exits the light guide panel in a direction substantially parallel to the optical axis.

In the context of the present invention, the term "light guide panel" is to be understood to mean a planar light guide element extending in two directions in one plane.

Here it can be advantageous for each light-emitting region to have a plurality of light decoupling prisms. Here the light decoupling prisms are preferably adapted so as to decouple the light from the light guide panel in a direction substantially parallel to the optical axis. The light decoupling prisms stand perpendicular to the direction of propagation of the light in the light guide panel. The light decoupling prisms have, for example, a setting angle of approx. 40°.

A feed (incoupling) from different sides into the light guide panel and a corresponding adaptation (of the shape) of the light decoupling prisms can in fact aid the implementation of a plurality of (more than two) different light functions.

In an advantageous embodiment it may be provided that the micro-entry optical unit array has a plurality of intermediate regions, preferably of planar design, associated with the light-emitting regions.

The micro-optical units of the micro-entry optical unit array and/or the micro-exit optical unit array can, for example, comprise convex lenses.

The intermediate regions of the micro-entry optical unit array preferably have no micro-entry optical units, and are adapted, for example, such that scattering of the light generated by means of the at least one light source is reduced. If the at least one light source generates parallel light, or the light from the at least one light source is collimated, for example by means of a collimator, before it reaches the entry optical unit, it is particularly advantageous for the intermediate regions to be of planar design.

In this sense, the light entering into the projection device through these intermediate regions is irrelevant for the formation of the intermediate image, and ergo, for the first light function. This light can preferably be shielded (see below).

It may be provided that the light-emitting regions in the light-emitting plane are distributed in a checkerboard pattern, and for the intermediate regions in the micro-entry optical unit array to be distributed in a checkerboard pattern, wherein the light-emitting regions are arranged downstream of the intermediate regions (in the direction of the optical axis). This means, for example, that this arrangement is a checkerboard pattern, preferably made up of squares, as viewed in the direction of the optical axis of the optical projection device. Here it is expedient if the regions of the checkerboard pattern having light-emitting regions are arranged to complement the regions of the checkerboard pattern corresponding to the intermediate regions.

In addition, it may be provided that the intermediate regions are opaque. There can also be a shielding element with opaque shielding regions corresponding to the intermediate regions, which shielding element shields the intermediate regions from the light of the at least one light source.

Moreover, it can be advantageous if the at least one additional light source is adapted as a support for the entry optical unit or the exit optical unit. The entry optical unit or the exit optical unit, which as the micro-entry optical unit array or the micro-exit optical unit array, is, for example, preferably made of silicone, is arranged on the additional light source, for example is applied to it, in particular is connected to the latter, for example, bonded with adhesive. This is particularly advantageous with regard to the synergetic utilisation of light-relevant components of a light module (for example, if the substrate panel is utilised as a light guide).

The entry optical unit, in particular the micro-entry optical unit array, is preferably arranged, for example applied, in particular bonded with adhesive, on one side of the at least one additional light source facing towards the at least one first light source.

The variety of light functions that can be implemented with the light module in accordance with the invention can be further increased if two additional light sources are provided, wherein a first of the two additional light sources supports the entry optical unit, and a second of the two additional light sources supports the exit optical unit.

The exit optical unit, in particular the micro-exit optical unit array, is preferably arranged, for example applied, in particular bonded with adhesive, on a side of the second additional light source facing away from the at least one first light source.

Furthermore, it can be advantageous if the light-emitting regions of the first additional light source and the light-emitting regions of the second additional light source are adapted and positioned relative to each other such that light beams generated by the respective light-emitting regions propagate in different, non-intersecting regions of the projection device. Here the light-emitting regions of the at least one or all additional light sources can be placed in regions of no significance for the beam path of the light emitted by the at least one light source, which emits, for example, light for the primary light function. By this means the primary light function is not impaired.

In addition, it may be provided that the projection device to have at least one screening device lying between the entry optical unit and the exit optical unit, which at least one screening device has apertures corresponding to the intermediate regions, and is adapted so as to shape the intermediate image (for example for a dipped light distribution), and/or to correct optical aberrations.

In another preferred embodiment, a first screening element can be provided, which first screening element is mounted in front of the light-emitting regions, and shields the light-emitting regions from the light of the at least one light source.

Here it can be advantageous if the first screening element is adapted to shape the intermediate image from the light emitted by the at least one light source, for example for a dipped beam distribution.

Furthermore, it can be advantageous if the light-emitting regions in the light emission plane of the at least one additional light source take the form of horizontal strips, extending transverse to the optical axis of the optical projection device and spaced vertically from each other, preferably equidistantly, and the screening element has opaque regions corresponding to these strips.

The screening element can, for example, be arranged on the light exit side with regard to the entry optical unit and in front of the light guide panel, for example on a light-emitting surface of the entry optical unit, or on a side of the light guide panel facing towards the at least one light source; in particular it can be applied to the light-emitting surface of the entry optical unit, or to the side of the light guide panel facing towards the at least one light source.

In addition, it can be advantageous if the at least one additional light source is adapted as a support for at least the first screening element. The first screening element is preferably arranged on the at least one additional light source, for example, is applied to it, in particular is imprinted onto the latter.

The first screening element is preferably arranged, for example applied, in particular bonded with adhesive, on a side of the at least one additional light source facing towards the at least one light source.

Further advantages ensue if two additional light sources are provided, wherein a first additional light source supports at least the first screening element, a second additional light source supports the exit optical unit, and the first screening element is mounted in front of the light-emitting regions of the first additional light source. The exit optical unit, in particular the micro-exit optical unit array, is preferably arranged, for example applied, in particular bonded with adhesive, on a side of the second additional light source facing away from the at least one light source.

In addition, it can be advantageous if the light-emitting regions of the first additional light source and the light-emitting regions of the second additional light source are adapted and positioned relative to each other, such that light beams generated by the respective light-emitting regions propagate in different, non-intersecting regions of the projection device.

In addition, a second screening element can be provided, which second screening element is mounted in front of the light-emitting regions of the second additional light source, and is arranged to shield the second additional light source, and/or to limit light emitted by the first additional light source. By this means the amount of stray light and/or aberrations can be reduced by means of the second screening element.

In addition, it can be advantageous with regard to the compactness of the design of the projection device if the first additional light source is adapted as a support for the second screening element. The second screening element is preferably arranged on the first additional light source, for example, is applied to it, in particular is imprinted onto the latter.

The second screening element is preferably arranged on a side of the first additional light source facing away from the at least one light source, for example applied, in particular bonded with adhesive.

It can be advantageous if the light distribution of the first predefined type complements the light distribution of the second predefined type to form a total light distribution, or if the light distribution of the first predefined type is independent of the light distribution of the second predefined type.

Here "independent" means that the light distribution of the second type can be generated independently of whether the light distribution of the first type is actually being generated or not. For example, a daytime running light can be on—can be generated with the light generated by means of the at least one additional light source, without a dipped beam distribution at the same time being emitted—while the at least one light source is off.

As already stated, the first predefined type of light distribution can be a primary light function light distribution, such as a dipped beam distribution. or a main beam distribution. Here the second predefined type of light distribution can be a secondary light function light distribution, for example a direction indicator light distribution, a position light distribution, a daytime running light distribution, a sign light distribution. Here at least one primary and at least one secondary light function can, for example, be implemented simultaneously, that is to say, corresponding light distributions can be generated simultaneously.

The light distributions of the first and second type can overlap each other (if both are generated). However, it can also be advantageous if the light distribution of the second type does not overlap the light distribution of the first type in the light image (e.g. a dipped beam with a sign light distribution).

The present invention can have one or a plurality of the following advantages, depending on the advantageous form of embodiment: a plurality of light functions possible from the same light-emitting surface; less installation space required than with separate implementation (a plurality of independent light modules); homogeneous visual appearance in the illuminated/non-illuminated state; light-emitting regions are imaged by lens optical units, as a result of which a better configuration of the light distribution and thus a better light utilisation is enabled.

It may be provided that the light distribution of a first predefined type to be a primary light function light distribution (in short: a primary light distribution), such as a dipped beam distribution or a main beam distribution, for example an adaptive main beam distribution, and for the light distribution of a second predefined type to be a secondary light distribution, such as:

- a static or dynamic direction indicator light distribution, emitted, for example, in the form of a running light;
- a position light distribution;
- a daytime running light distribution, which can be generated at least partially in the form of a running light;
- a light distribution which forms one or a plurality of identical or different logos,
- a welcome light function light distribution, wherein the primary light distribution and the secondary light distribution can preferably be emitted simultaneously.

The invention, together with further advantages, is explained in more detail in what follows by means of exemplary forms of embodiment, which are illustrated in the figures. Here:

FIG. 1 shows a motor vehicle light module in accordance with a first form of embodiment in a perspective view;

FIG. 1*a* shows a part of the motor vehicle light module of FIG. 1;

To improve readability, each figure is provided with a coordinate system. Here three directions are indicated: a horizontal H and a vertical V direction, and a primary emission direction Z of the motor vehicle light module.

The terms "above", "below", "vertical", "horizontal" etc. relate to a normal installation position of the motor vehicle light module in a motor vehicle. For example, the primary emission direction Z corresponds to the forward direction of movement of the motor vehicle if the motor vehicle light module is arranged in a motor vehicle headlamp so as to generate at least one primary light distribution.

Figure 1:
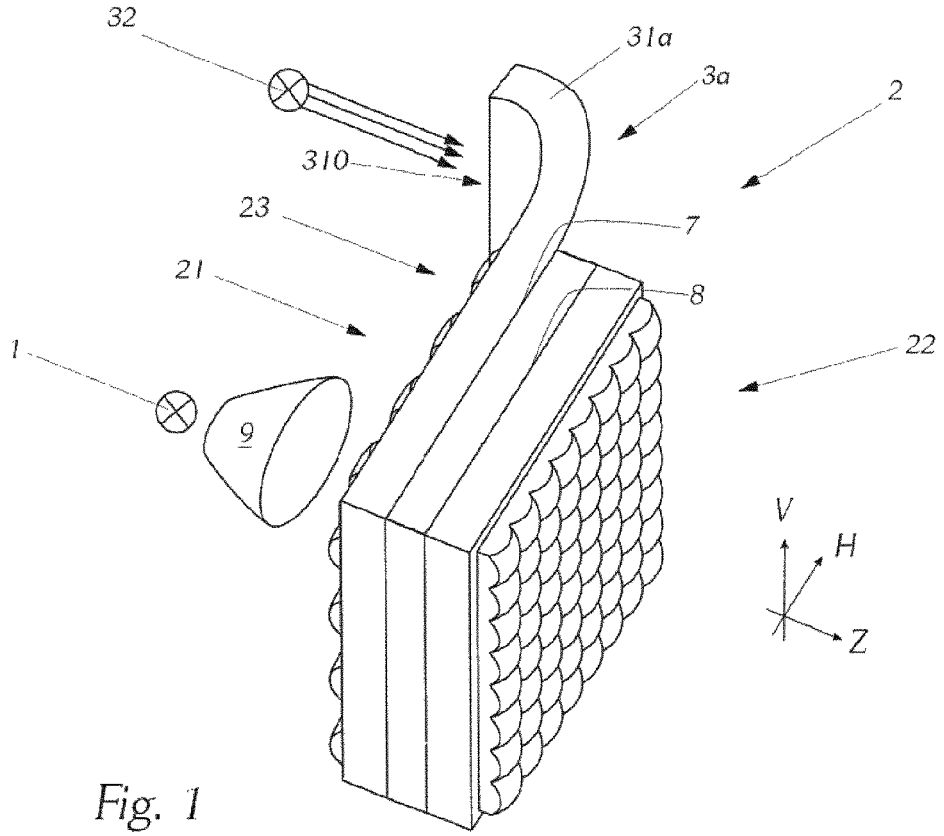
Figure 1A:
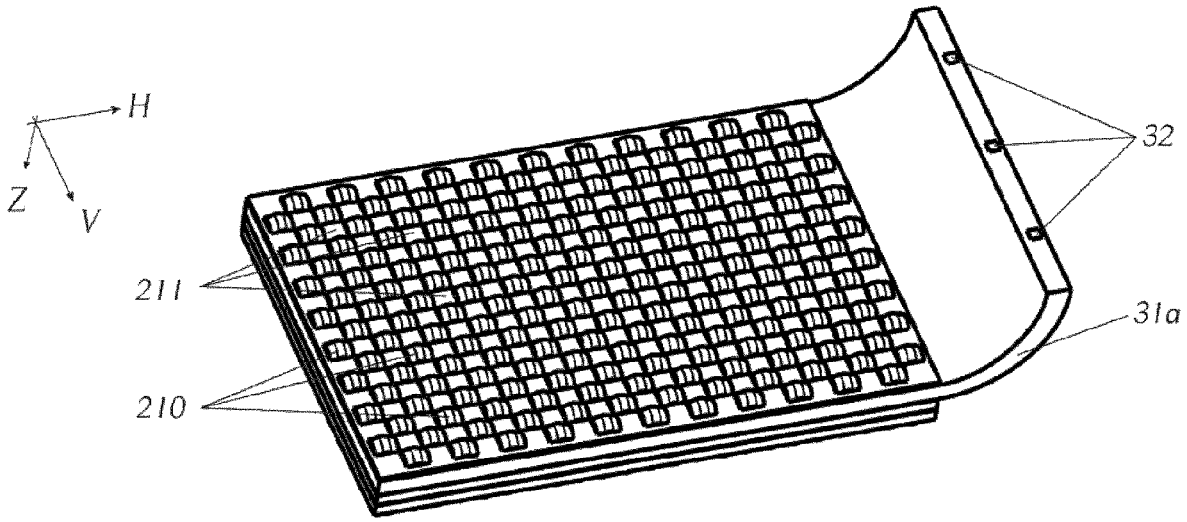
Figure 2:
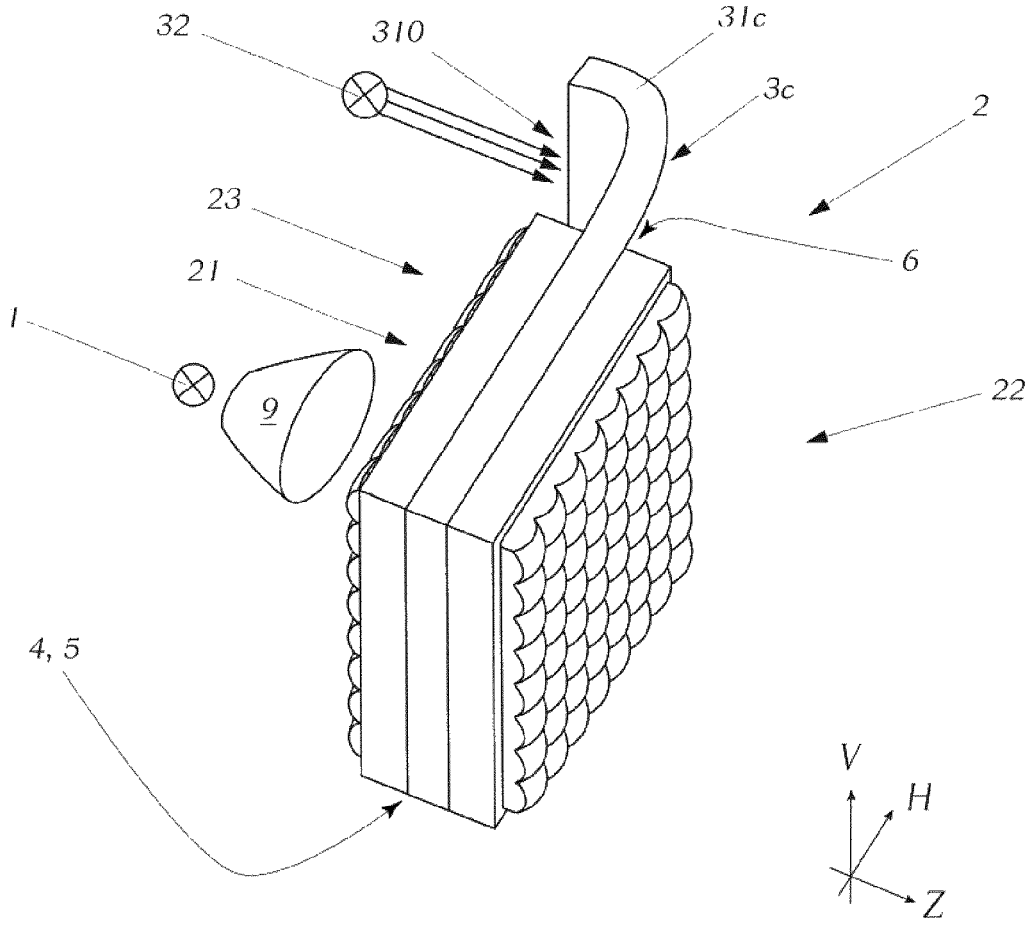
FIG. 2 shows a motor vehicle light module in accordance with a second form of embodiment in a perspective view.

Reference is first made to FIGS. 1, 1*a* and 2, and in particular to those parts and aspects of a motor vehicle light module that apply equally to the first and second forms of embodiment.

FIGS. 1, 1*a* and 2 show in each case a schematic representation of a motor vehicle light module (or a part of the motor vehicle light module) for a headlamp, in particular a motor vehicle headlamp, which can correspond to a light module in accordance with the invention. Such a motor vehicle light module is particularly suitable for motor vehicle headlamps in which a compact design is of primary importance, and a plurality of light functions (for example a primary and at least one secondary light function) should preferably be implemented simultaneously from the one and the same preferably continuous light-emitting surface. In the context of the present invention, this light-emitting surface corresponds to a light-emitting surface of an exit optical unit 22 at least of one projection device 2 (see also FIGS. 1 to 15). In addition to the at least one projection device 2 with the exit optical unit 22, the motor vehicle light module has at least one light source 1, for example an LED light source. A collimator 9 is preferably mounted in front of the at least one light source 1. The projection device 2 also has an entry optical unit 21. Here the entry optical unit 21 and the exit optical unit 22 are adapted so as to form an intermediate image, from light emitted by the at least one light source 1 and preferably collimated by the collimator 9, in an intermediate image plane lying between the entry optical unit 21 and the exit optical unit 22, and substantially transverse to an optical axis of the projection device 2. The exit optical unit 22 is adapted so as to image the intermediate image in the form of a light distribution of a first predefined type in a region in front of the motor vehicle light module.

The first type of light distribution can, for example, be a primary light function light distribution—that is to say, a light distribution, which is generated when the primary light function of the motor vehicle light module is activated. In particular, a primary light function light distribution can be a dipped beam distribution or (for example an adaptive or dazzle-free) main beam distribution.

In addition, at least one other light source—the so-called additional light source 3*a*, 3*c*—is provided, which at least one second additional light source 3*a*, 3*c* is adapted so as to emit light between the entry optical unit 21 and the exit optical unit 22. By this means a location or a region is specified, in which the at least one additional light source emits light (generated by the latter). As can already be seen from FIGS. 1, 1*a* and 2, the at least one additional light source 3*a*, 3*c* is preferably not a point light source. It is advantageous if the at least one additional light source 3*a*, 3*c* extends spatially and occupies a predefined region between the entry optical unit 21 and the exit optical unit of the projection device. Here, as can be seen from the examples described below, the at least one additional light source 3*a*, 3*b*, 3*c*, 3*d* (see also FIGS. 7 to 15) can comprise an illuminant 32, which is external to the region between the entry optical unit 21 and the exit optical unit 22.

The light emitted by the at least one additional light source 3*a*, 3*b* is imaged by means of the exit optical unit 22 in the (same) region in front of the light module in the form of a light distribution of a second predefined type. The second type of light distribution is preferably a secondary light function light distribution—that is to say, a light distribution, which is generated when the secondary light function of the motor vehicle light module is activated. In particular, a secondary light function light distribution can be a daytime running light distribution, a position light distribution, a direction indicator light distribution, a sign light distribution, or similar, such as a signal light running light, in particular a turning signal running light (also a position light distribution, a daytime running light distribution as a running light). In addition, logos and welcome light functions can be implemented.

Here the entry optical unit 21 and the at least one additional light source 3*a*, 3*c* are adapted and associated with each other such that neither the at least one additional light source 3*a*, 3*c*, nor the light emitted by the at least one additional light source 3*a*, 3*c*, changes the intermediate image.

The light generated by the at least one additional light source 3*a*, 3*b*, 3*c*, 3*d* leaves the intermediate image generated with the light of the at least one light source 1 uninfluenced/unimpaired/unchanged. The at least one additional light source 3*a*, 3*c* preferably generates an additional/second intermediate image in the intermediate image plane, which does not overlap the (original) intermediate image.

The light generated by the at least one light source 1 propagates in accordance with (or along) a first beam path 100, and the light generated by the at least one additional light source 3*a*, 3*b*, 3*c*, 3*d*—in accordance with a second, different beam path 300*a*, 300*b*, 300*c*, 300*d*—propagates through the optical projection device 2 (see in particular FIGS. 7 to 15). Here it is expedient if the at least one additional light source 3*a*, 3*b*, 3*c*, 3*d* lies external to the first beam path 100—that is to say, not in the first beam path.

It is advantageous if the at least one additional light source 3*a*, 3*b*, 3*c*, 3*d* is adapted so as to generate collimated light, substantially parallel to the optical axis of the projection device 2.

For this reason, an accurate positioning of the at least one additional light source 3*a*, 3*b*, 3*c*, 3*d* between the entry optical unit 21 and the exit optical unit 22, and in particular with regard to the intermediate image plane, is not relevant. Nevertheless it is conceivable to position the at least one additional light source 3*a*, 3*b*, 3*c*, 3*d* in the intermediate image plane.

It can be advantageous if the entry optical unit 21 and the exit optical unit 22 are adapted as matrix-like arrays of micro-entry optical units 210 and micro-exit optical units 220—a micro-entry optical unit array and a micro-exit optical unit array respectively—arranged in planes standing transverse to the optical axis of the optical projection device 2, wherein each micro-entry optical unit 210 corresponds to at least one, preferably exactly one, micro-exit optical unit 220, such that they have a common optical axis, preferably extending horizontally, and form a micro-optical system. The micro-entry/exit optical units 210, 220 can be adapted, for example, as convex lenses. The direction of the optical axis of each micro-optical system preferably coincides with the primary emission direction Z.

In the context of the present invention, the term "common optical axis of two optical units" means that the optical axes of these two optical units are substantially coincident.

As already stated in the introduction to the description, the person skilled in the art can obtain further details of the micro-optical unit arrays and of the projection devices, which can be formed with the aid of such micro-optical unit arrays, from the above-cited applications of the applicant: WO 2015/058227 A1; WO 2017/066817 A1; WO 2017/066818 A1.

Furthermore, it can be advantageous if the at least one additional light source 3*a*, 3*b*, 3*c*, 3*d* has a plurality of light-emitting regions 30*a*, 30*b*, 30*c*, 30*d*, spaced apart from each other, for purposes of emitting the light between the entry optical unit 21 and the exit optical unit 22 (see in particular FIGS. 9 to 15), which light-emitting regions 30*a*, 30*b*, 30*c*, 30*d* are arranged in a plane standing substantially transverse to the optical axis of the projection device 2—in the so-called light emission plane. Based on the above, it is to be understood that this plane is located between the entry optical unit 21 and the exit optical unit 22. A light beam 300*a*, 300*b*, 300*c*, 300*d* is preferably generated by means of each light-emitting region, which beam propagates parallel to the optical axis of the projection device 2.

It is advantageous if the light-emitting regions 30*a*, 30*b*, 30*c*, 30*d* are associated with the exit optical unit 22. It is particularly advantageous if each light-emitting region is associated with one of the regions of the exit optical unit 22, for example, a single micro-exit optical unit 210—if the exit optical unit is adapted as a micro-exit optical unit array—or a horizontal row of the micro-exit optical units. With conventional, for example, linear light guides/lighting bodies, the decoupling element lies on the rear face of the lighting body (with regard to the emission direction Z). The light deflected by the decoupling element exits on the opposite side through a curved exit surface of the lighting body. As is known from the prior art, it is possible to influence the emission characteristic of the lighting body by configuring that region of the exit surface where the light leaves the lighting body. The above-cited association of the light-emitting regions 30*a*, 30*b*, 30*c*, 30*d* of the exit optical unit 22 can, for example, serve to ensure that the curvature of the exit optical unit 22, for example of its micro-exit optical units 210, is used to configure the light image generated by the at least one additional light source 3*a*, 3*b*, 3*c*, 3*d*. The light image can thus be formed on the one hand by the size and/or shape of the light-emitting regions 30*a*, 30*b*, 30*c*, 30*d* of the at least one additional light source 3*a*, 3*b*, 3*c*, 3*d*, and/or by the imaging properties of the exit optical unit 22, such as its thickness, that is to say, the thickness of the micro-exit optical units 220, and/or the shape of a light-emitting surface, for example its (local/global) curvature. By this means the efficiency of at least one additional light source 3*a*, 3*b*, 3*c*, 3*d* is increased.

In FIGS. 1, 1*a* and 2 it can be seen that the at least one additional light source 3*a*, 3*c* has a light guide element 31*a*, 31*c* and the already briefly cited illuminant 32, wherein the illuminant 32 is associated with the light guide element 31*a*, 31*c*. The illuminant 32 is preferably adapted as an LED illuminant. Here the light-emitting regions 30*a*, 30*b*, 30*c*, 30*d* (not visible in FIGS. 1 and 2) are preferably arranged in the light guide element 31*a*, 31*b*, 31*c*, 31*d*. The illuminant 32, for example, does not lie between the entry optical unit 21 and the exit optical unit 22, as shown in FIGS. 1, 1*a* and 2. The illuminant 32 can be adapted as an LED illuminant. It is quite conceivable that both the LED light source 1 and also the LED illuminant 32 are mounted on a common circuit board. In addition, the LED light source 1 and the LED illuminant 32 can each have a plurality of LEDs, wherein both the LEDs of the LED light source 1 and also the LEDs of the LED illuminant 32 are arranged in a plane standing substantially perpendicular to the optical axis of the projection device 2, and preferably emit light in the direction of the optical axis. The LED illuminant can, for example, have three LEDs arranged side-by-side (not shown), or one above another (see FIG. 1*a*). An arrangement of the LED illuminant from above/below makes it possible to arrange a plurality of projection devices 2 side-by-side in a motor vehicle headlamp.

The light guide element can be adapted as a light guide panel 31*a*, 31*b*, 31*c*, 31*d*, which is arranged (in the region between the entry optical unit 21 and the exit optical unit 22) substantially transverse to the optical axis of the projection device 2. At this point a reference to the above-cited prior art is appropriate. The international applications WO 2015/058227 A1, WO 2017/066817 A1, WO 2017/066818 A1 all show light modules—so-called micro-projection light modules—in which a micro-entry optical unit array and a micro-exit optical unit array are in each case mounted, in particular bonded with adhesive, to a substrate panel, for example a glass panel. The substrate panels are often present because the micro-entry optical units and micro-exit optical units of the micro-projection light modules can already be arranged on such a glass support/substrate panel in the course of production. With the aid of substrate panels, for example, optical properties, such as the focal length of the lenses (micro-optical units) can be predefined. If a certain focal length is desired, it can be achieved by varying the "thickness" of the substrate panels. The micro-entry optical units and micro-exit optical units can be made of a polycarbonate (PC) and can be arranged, for example bonded with adhesive, on a substrate panel made of crown glass (for example B270® glass). The light guide element can, for example, be made of a polycarbonate. By this means the thickness, that is to say, the extent in the direction of an optical axis, of the entire projection device is also predefined. Substrate panels for the micro-entry optical unit array and the micro-exit optical unit array can be of different thicknesses. This is for the same reason: in practice the thickness of the projection device is predefined by the fixed dimensions of the lenses in the micro-entry optical unit array and the micro-exit optical unit array. In addition, conventional light modules can have one or more screens, which are also applied to a substrate panel—a so-called shutter substrate (here "shutter" is an alternative English word for screen). Here the thickness of the projection device can be reduced during the production process such that the shutter substrate can be introduced.

Provision can advantageously be made for one or a plurality of the light guide panels 31*a*, 31*b*, 31*c*, 31*d* to be adapted as a substrate panel of the micro-entry optical unit array, and/or the micro-exit optical unit array, or as a shutter substrate.

The light guide panel 31*a*, 31*b*, 31*c*, 31*d* has at least one light incoupling surface 310*a*, 310*c*, preferably arranged at the side of, or below, or above, the light guide panel 31*a*, 31*b*, 31*c*, 31*d* for purposes of incoupling light 320*a*, 320*c* of the illuminant 32, which light propagates in the light guide panel and is emitted from the light guide panel in the light-emitting regions 30*a*, 30*b*, 30*c*, 30*d*. The specialist knowledge includes the fact that the light coupled into a light guide propagates by virtue of total reflection.

FIGS. 1 and 2 show light guide panels, which are adapted so as to be planar in the region between the entry optical unit 21 and the exit optical unit 22 and have a curved region 330*a*, 330*c* outside this region. The light guide panels 31*a*, 31*c* shown are preferably curved towards their light incoupling surfaces 310*a*, 310*c*. By this means, for example, the above-cited arrangement of the at least one light source 1 and the illuminant 32 in a common plane standing substantially perpendicular to the optical axis is enabled. The light 320*a*, 320*c* emitted by the respective illuminant 32 parallel to the optical axis of the projection device 2 is coupled into the light guide panel 31*a*, 31*c* via the respective light incoupling surface 310*a*, 310*c* associated with the illuminant 32, propagates by virtue of total reflection through the curved region 330*a*, 330*c* into the region of the light guide panel 31*a*, 31*c* lying between the entry optical unit 21 and the exit optical unit 22, and is decoupled in the light-emitting regions 30*a*, 30*b*, 30*c*, 30*d* substantially parallel to the optical axis of the projection device 2.

In the context of the present invention, the term "light guide panel" is to be understood to mean a light guide element that is adapted so as to be planar in the region where light is decoupled from the light guide panel, which light guide element extends in two directions in one plane.

It is appropriate for each light-emitting region 30*a*, 30*b*, 30*c*, 30*d* to have a plurality of light decoupling prisms. In order to enable an accurate imaging via the corresponding micro-exit optical units 220, prisms with a setting angle of approx. 40°, which decouple the light in parallel, have proved to be practical. The setting angle can also be varied such that an even decoupling of the light takes place. The light decoupling prisms are adapted so as to decouple the light from the light guide panel 31*a*, 31*b*, 31*c*, 31*d* in a direction substantially parallel to the optical axis. The light decoupling prisms preferably stand perpendicular to the direction of propagation of the light in the light guide panel.

Two different forms of embodiment have proved to be particularly appropriate for the positioning of the light guide optical units.

In accordance with a first form of embodiment, in which, as can be seen below, the at least one additional light source 3*a*, 3*b* preferably replaces the substrate panel for the entry optical unit 21 and/or the exit optical unit 22, the entry optical unit 21 and the exit optical unit 22 are adapted as a micro-entry optical unit array and a micro-exit optical unit array respectively, wherein the micro-entry optical unit array has a plurality of intermediate regions 211, which are associated with the light-emitting regions 30*a*, 30*b*, and are preferably of planar design (this can be seen in particular in FIG. 1*a*).

The intermediate regions 211 of the micro-entry optical unit array are characterised by the fact that they do not have any micro-entry optical units—in this case they have no convex lenses. In this sense the light entering the projection device through these intermediate regions 211 is irrelevant for the formation of the intermediate image, and ergo for the first light function.

The light-emitting regions 30*a*, 30*b* are preferably (see FIG. 1*a*) distributed in the light emission plane in a checkerboard pattern. The intermediate regions 211 are also distributed in the micro-entry optical unit array in a checkerboard pattern, wherein the light-emitting regions 30*a*, 30*b* are arranged downstream of the intermediate regions 211 (as viewed in the direction of the optical axis of the projection device 2). This means, for example, that a light-emitting region 30*a*, 30*b* is placed behind (as viewed in the direction of the optical axis of the projection device 2) each intermediate region 211 of the micro-entry optical unit array (see e.g. FIGS. 9 to 11).

Figure 3:
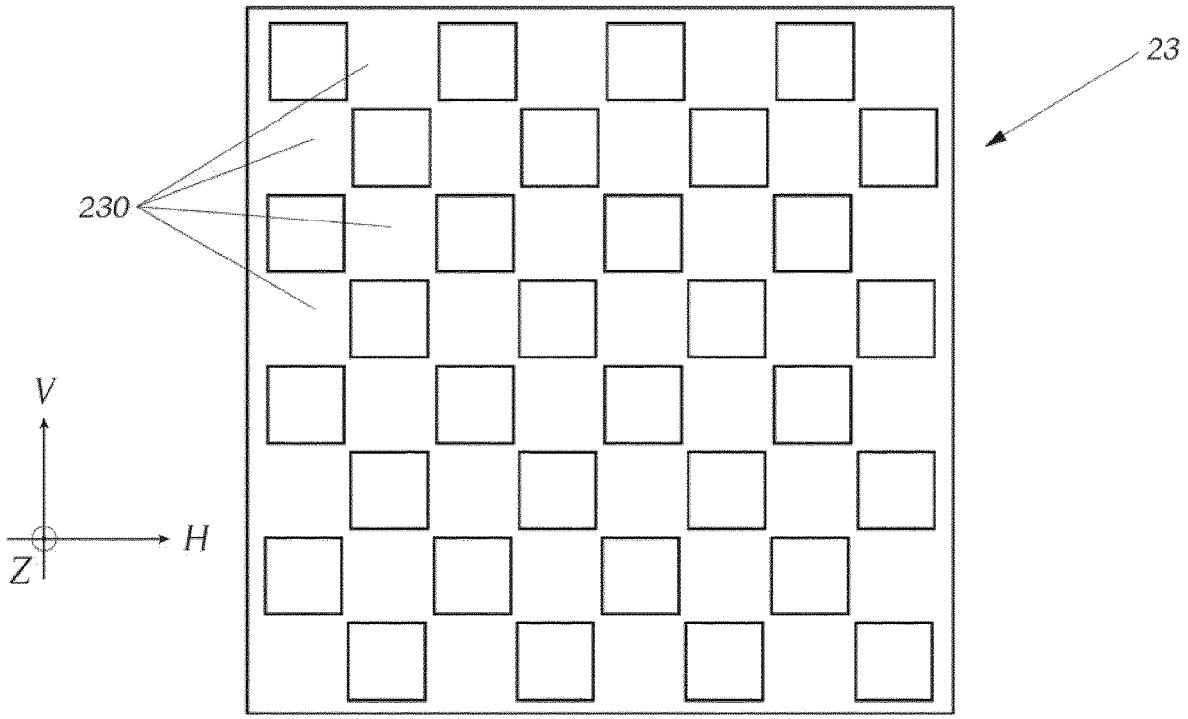
FIG. 3 shows a shielding element for a motor vehicle light module of FIG. 1.

It can be appropriate if the intermediate regions 211 are adapted so as to be opaque, or if a shielding element 23 is provided with opaque shielding regions 230 corresponding to the intermediate regions 211 (see FIG. 3). The shielding element 23, for example, serves the purpose of shielding the intermediate regions 211 from the light of the at least one light source 1.

By this means it can be achieved, for example, that the light from the at least one light source 1 does not hit the light-emitting regions 30, and is not scattered on the latter. This leads to a reduction of the unwanted stray light.

The shielding element 23 is preferably arranged in a plane orthogonal to the optical axis of the optical projection device 2, and preferably extends over substantially the entire light entry surface of the entry optical unit 21.

Here it is advantageous if the shielding element 23 is arranged on the light entry side with regard to the entry optical unit 21, for example on a light entry surface of the entry optical unit 21, in particular is applied to the light entry surface of the entry optical unit 21, and preferably allows the light generated by the at least one light source 1 to be incident on the micro-entry optical unit 210 but not on the intermediate regions 211 of the micro-entry optical unit array.

As can be seen in FIG. 3, the shielding element 23 can be adapted as a plane screen with a plurality of apertures complementing the opaque shielding regions 230. However, it is also conceivable for the shielding element 23 to be adapted as a continuous layer, wherein this layer has regions of different light transmission/transparency. It is also conceivable for the light transmittance/transparency of these regions to be able to be changed in a controlled manner, such as is the case in a liquid crystal display.

In this form of embodiment, the at least one additional light source 3*a* can act as a support/support element for the entry optical unit 21 (FIGS. 1 and 7 to 9).

The entry optical unit 21 is preferably arranged, for example applied, in particular bonded with adhesive, on one side of the at least one additional light source 3*a*, facing towards the at least one first light source 1.

Figure 10:
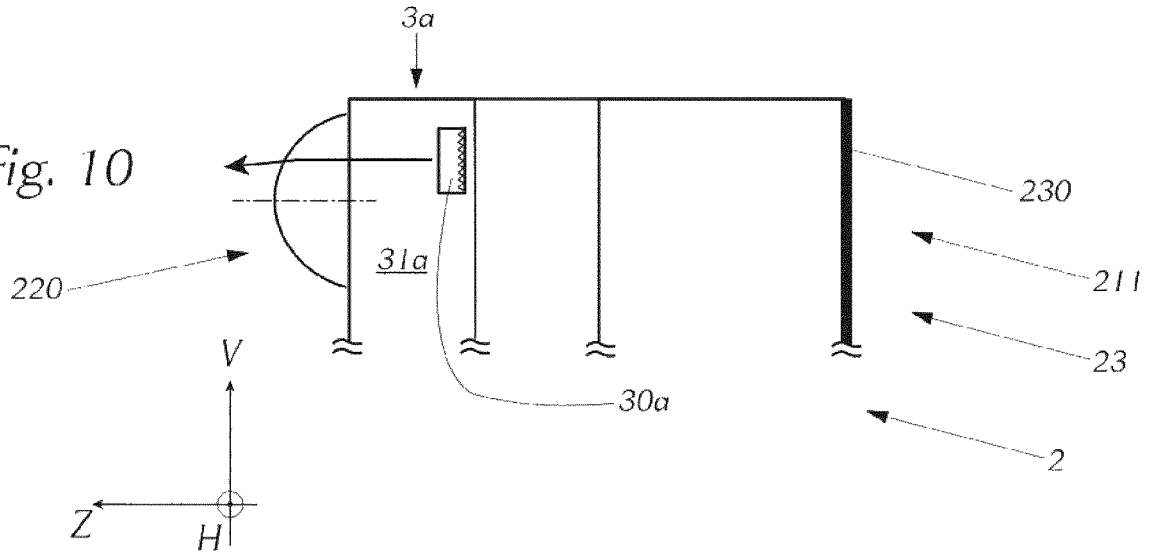
FIG. 10 and FIG. 11 show cross-sectional views of an enlarged part of a projection device of a motor vehicle light module in accordance with a first form of embodiment, with two additional light sources.
Figure 11:
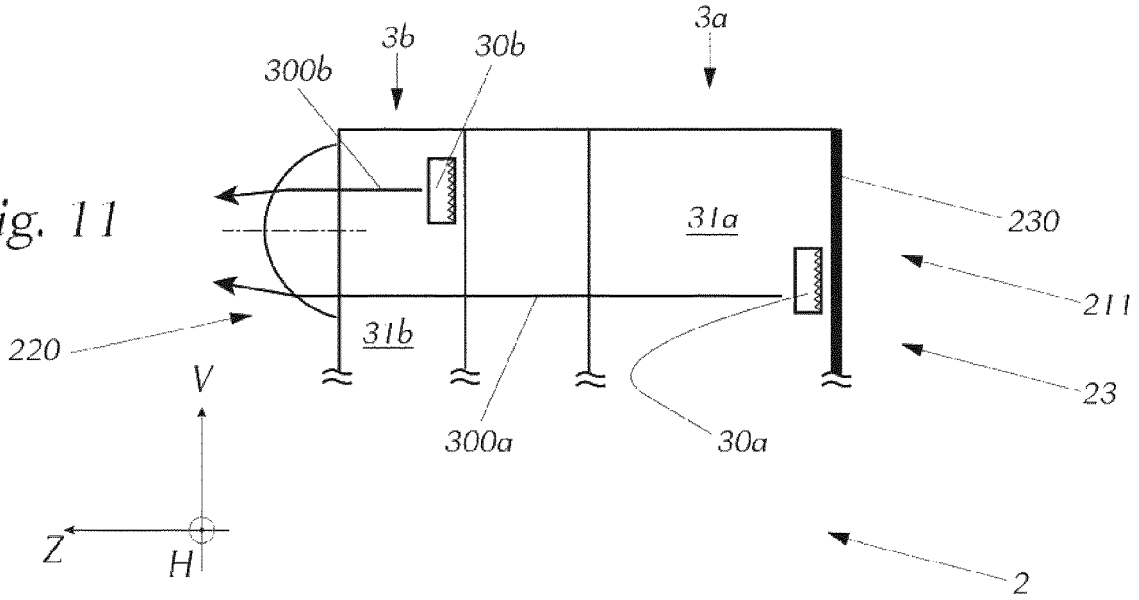
Figure 12:
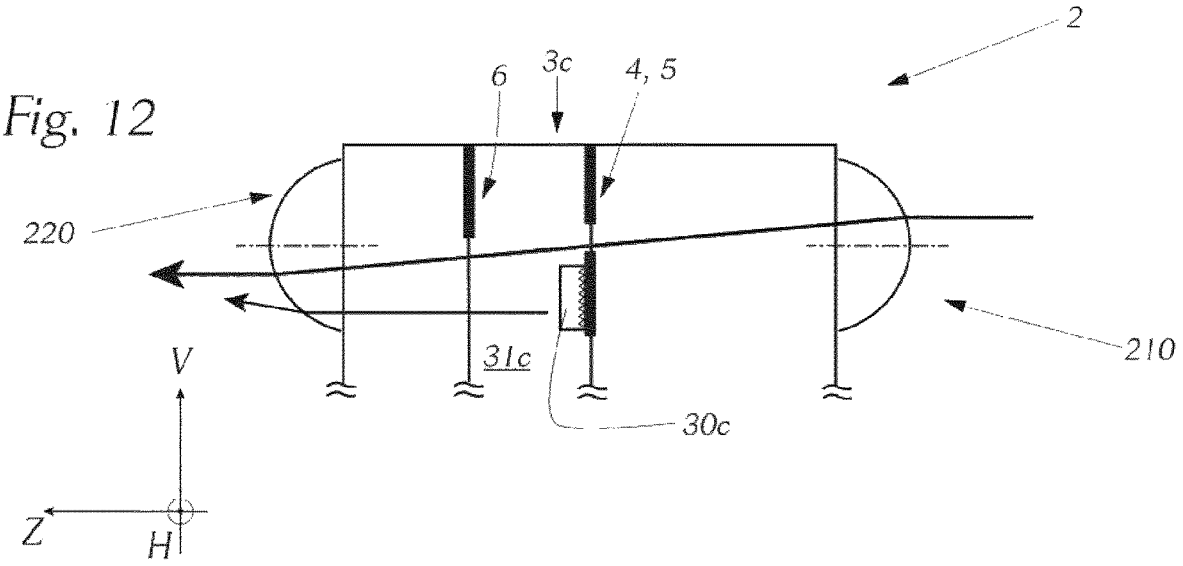
FIG. 12 and FIG. 13 show cross-sectional views of an enlarged part of a projection device of a motor vehicle light module in accordance with a second form of embodiment, with an additional light source.
Figure 13:
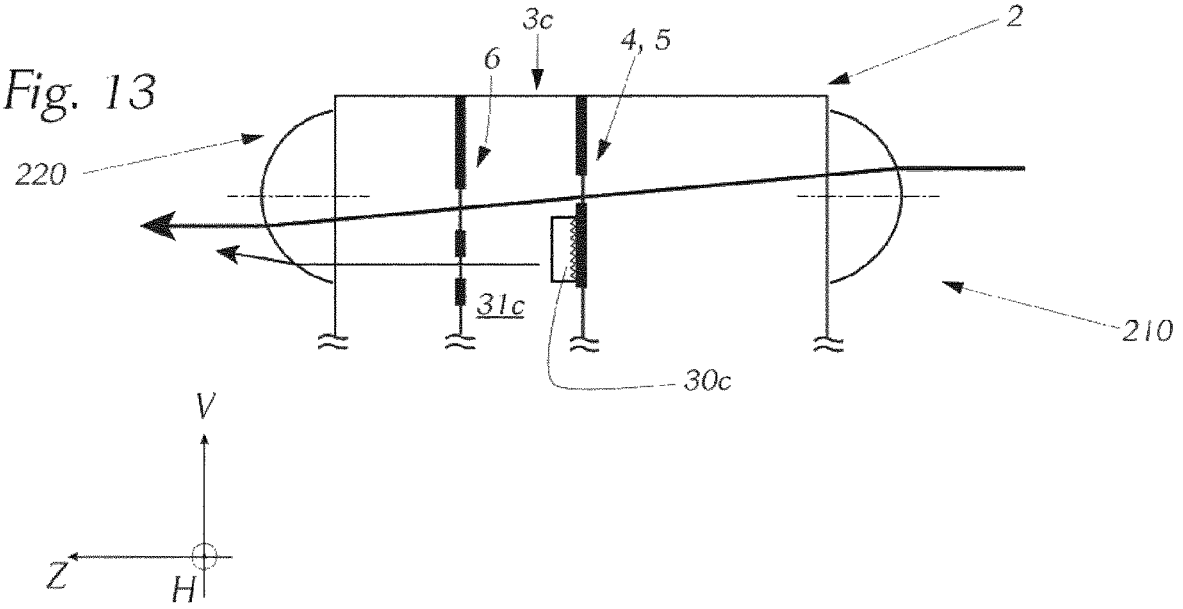

The at least one additional light source 3*a* can act as a support/support element for the exit optical unit 22 (FIG. 10).

The exit optical unit 22 is preferably arranged, for example applied, in particular bonded with adhesive, on one side of the at least one additional light source 3*a*, facing away from the at least one first light source 1.

Exactly two additional light sources 3*a*, 3*b* can also be provided, wherein a first of the two additional light sources 3*a* supports the entry optical unit 21, and a second of the two additional light sources 3*b* supports the exit optical unit 22. By this means, for example, the variety of the secondary light functions that can be implemented can be increased.

Here it is expedient if the light-emitting regions 30*a* of the first additional light source 3*a* and the light-emitting regions 30*b* of the second additional light source 3*b* are adapted and positioned relative to each other such that light beams 300*a*, 300*b* generated by the corresponding light-emitting regions 30*a*, 30*b* propagate in different, non-intersecting regions of the projection device 2.

In FIGS. 7 to 11 in particular, it can be seen that the light-emitting regions 30*a* and 30*b* can emit collimated light parallel to the optical axis of the projection device. The light-emitting regions 30*a* and 30*b* are dimensioned and positioned such that the light beams 300*a* emitted by the first light-emitting regions 30*a* are parallel to, for example above (FIG. 10), the light beams 300*b* emitted by the second light-emitting regions 30*b*. If the first light-emitting regions 30*a* are here positioned below an optical axis of the corresponding micro-exit optical units 220, the beams 300*a* are refracted by these micro-emitting optical units 220, and imaged in a region above the horizon (HH-line). If the second light-emitting regions 30*b* are at the same time positioned below an optical axis of the corresponding micro-exit optical units 220, the beams 300*b* are refracted by this micro-exit optical unit 220 and imaged in a region below the horizon. In this way, a first additional light source 3*a* can be used to generate a light distribution emitted above the horizon—for example a sign light distribution, and a second additional light source 3*b* can be used to generate a light distribution lying below the horizon—for example a daytime running light or a direction indicator light distribution.

Figure 4:
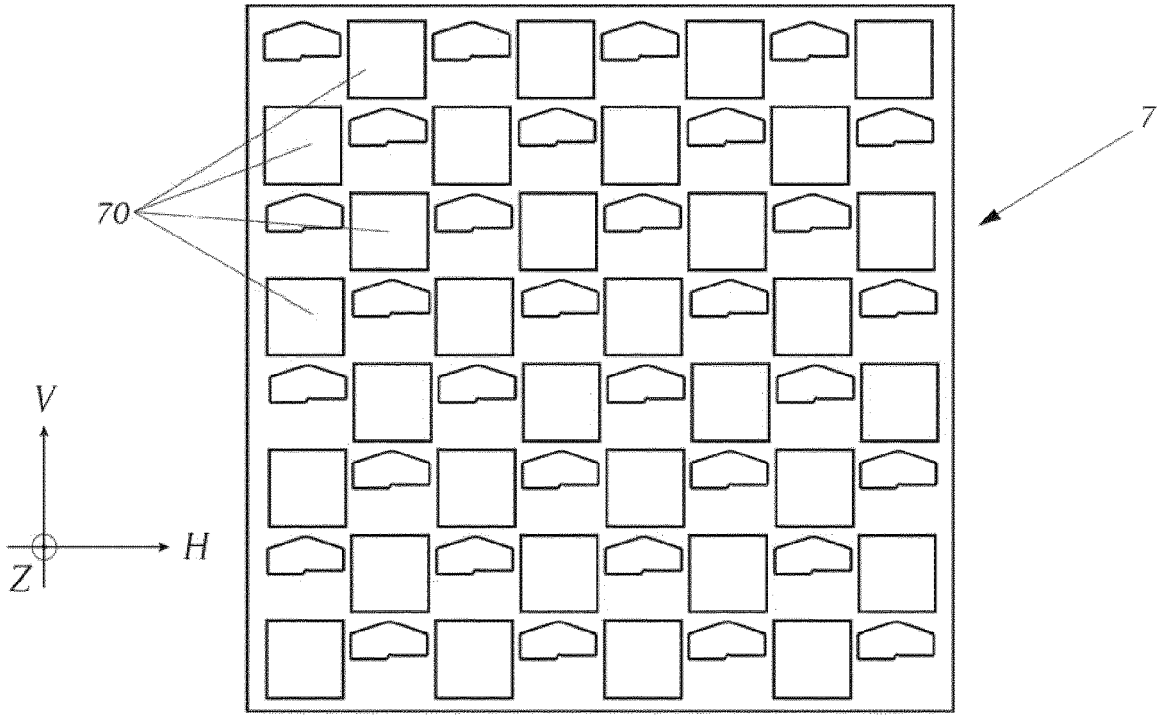
FIG. 4 shows a screening device for a motor vehicle light module of FIG. 1.
Figure 5:
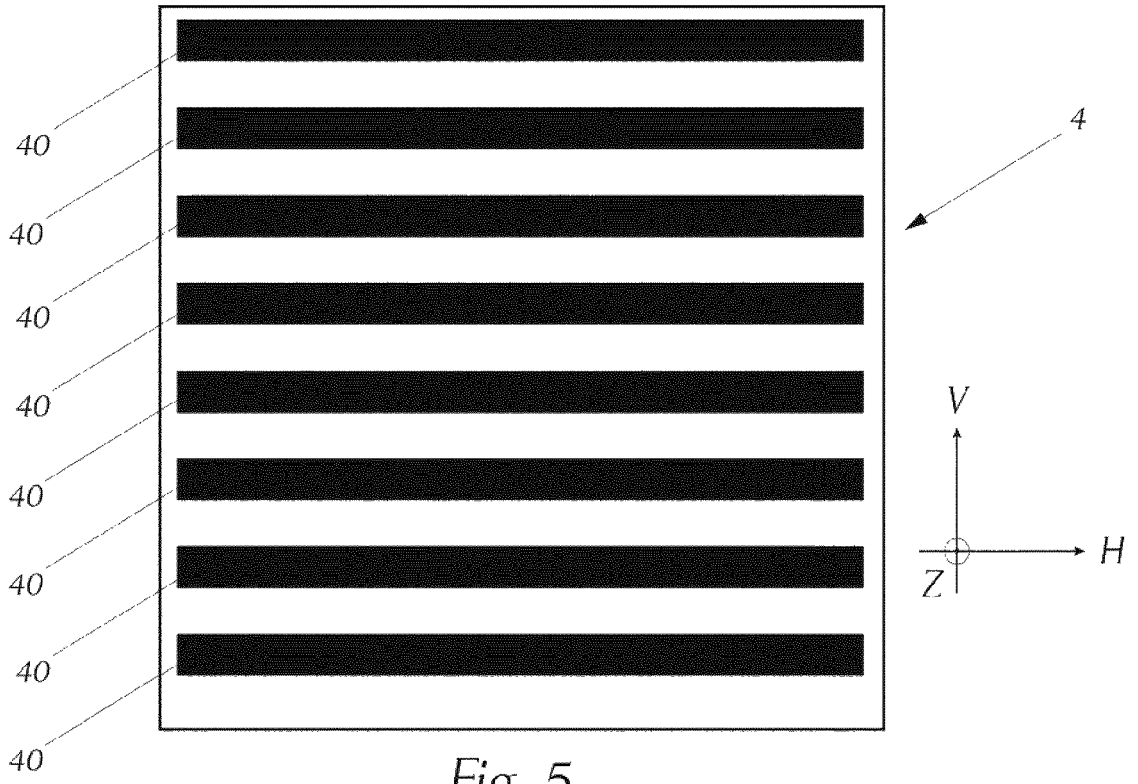
FIG. 5 and FIG. 6 show a first screening element of the motor vehicle light module of FIG. 2.
Figure 6:
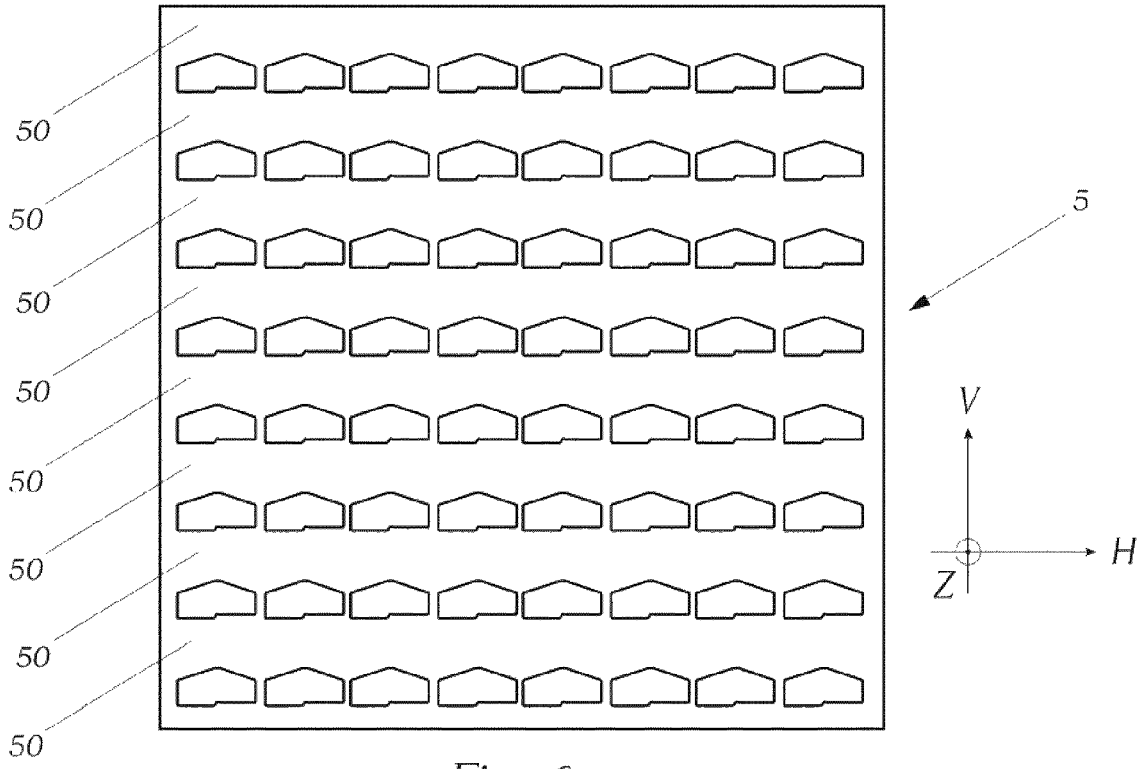
Figure 7:
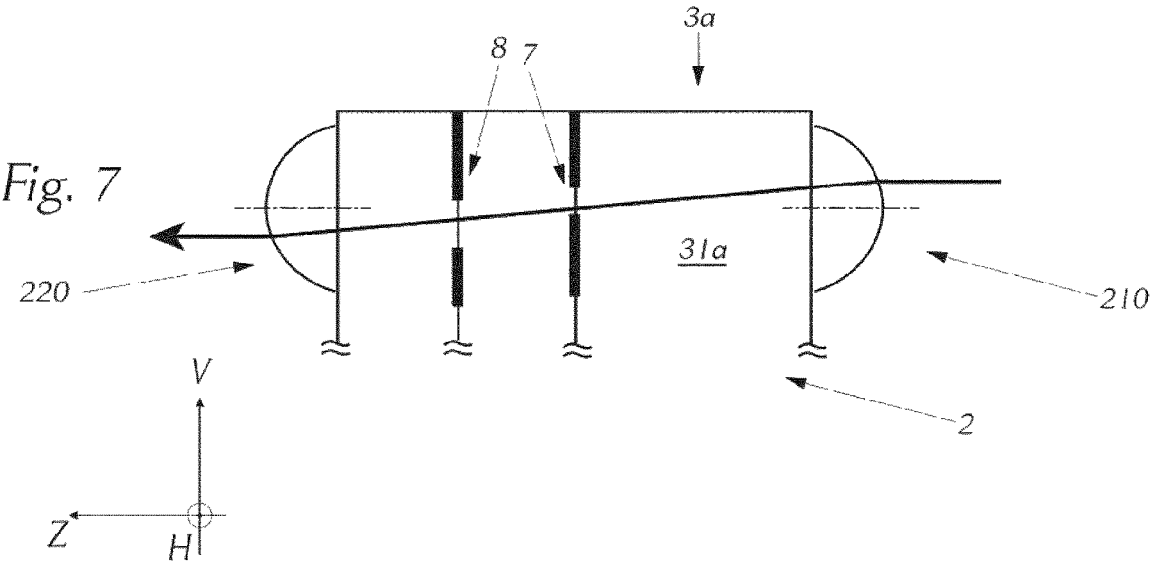
FIG. 7 to FIG. 9 show cross-sectional views of an enlarged part of a projection device of a motor vehicle light module in accordance with a first form of embodiment, with an additional light source.
Figure 8:
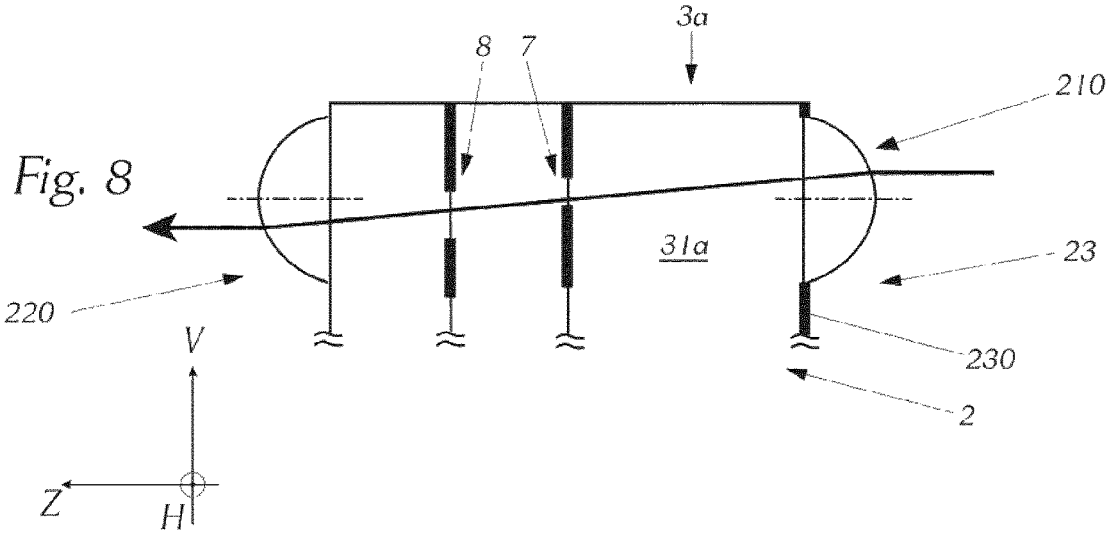
Figure 9:
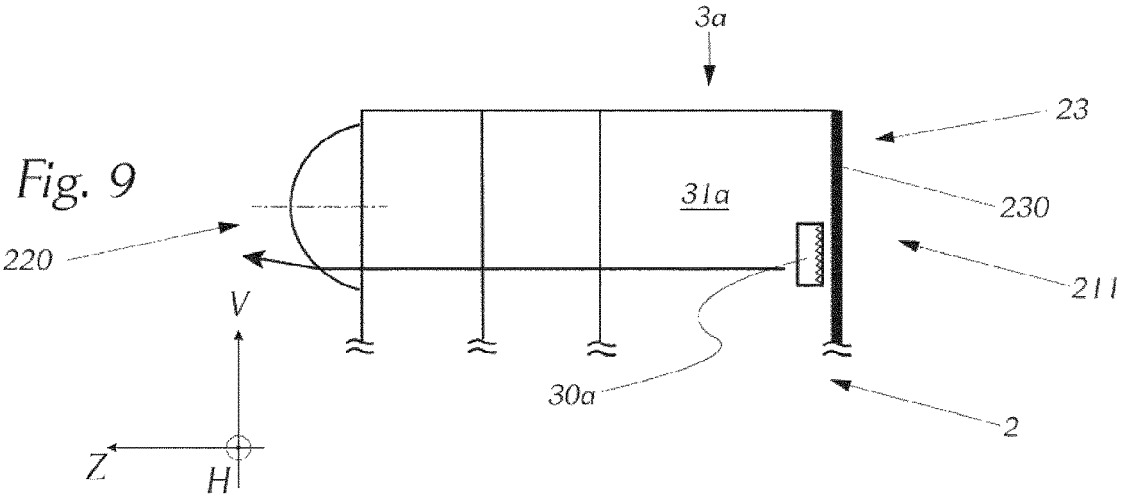

In addition, the projection device 2 can have at least one screening device 7, 8 lying between the entry optical unit 21 and the exit optical unit 22, which at least one screening device 7, 8 has apertures 70 corresponding to the intermediate regions 211 (see FIG. 4). This has the advantage, for example, that the light coming from the light-emitting regions 30*a*, 30*b* can reach the corresponding micro-exit optical units 220 unhindered. In addition, the screening device 7, 8 can be adapted so as to shape the intermediate image, for example to create a dipped beam distribution with an asymmetrical cut-off line, and/or to correct optical aberrations. The screening device 7, 8 can comprise a plurality of screens.

Here it is expedient to adapt the shape of the at least one screening device 7, 8 in accordance with the light distribution to be generated of the first and/or the second type. Thus, for example, FIG. 4 shows a screening device 7 for the generation of a light distribution of the first type adapted as a dipped beam distribution. The screening device 7 can, for example, be applied to the light exit side of the light guide panel 31*a*, 31*b*, and has an arrangement of apertures 70, which take account of the intermediate regions 211 in the micro-entry optical unit array, or the opaque regions of the shielding element 23.

In a second preferred form of embodiment (see FIGS. 2, 5, 6 and 12 to 15) a first screening element 4, 5 is provided, which first screening element 4, 5 is mounted in front of the light-emitting regions 30*c*, 30*d* and is adapted so as to shield at least the light-emitting regions 30*c*, 30*d* from the light of the at least one first light source 1. The first screening element 4, 5 is expediently provided with correspondingly opaque regions 40, 50 for purposes of shielding the light-emitting regions 30*c*, 30*d*. The at least one additional light source 3*c* preferably supports the first screening element 4, 5 (FIG. 2). Furthermore, it can be appropriate if the first screening element 4, 5 is arranged, for example applied, in particular bonded with adhesive, on one side of the at least one additional light source 3*c* facing towards the at least one first light source 1—that is to say, on the light entry side.

Illumination of the light-emitting regions 30*c*, 30*d* with the light of the at least one light source 1, with which a light distribution of the primary light function, for example a dipped beam distribution, is generated, can lead to an unintentional influence on the dipped beam distribution and to high, possibly impermissible, scattered light values. The light guide panel can at the same time serve as a mounting for the micro-lens array (micro-entry optical unit array and/or micro-exit optical unit array). This simplifies the system, because in this case the light guide panel can replace the substrate panel for micro-entry optical units or micro-exit optical units, which reduces the insertion loss of the projection device and also reduces the required installation space.

It should be noted at this point that many of the conventional projection modules with micro-optical unit arrays cited above have a support or support element for screens between their entry and exit optical units. In the preferred form of embodiment in question, the at least one additional light source 3*c* performs the function of such a support.

The light-emitting regions 30*c*, 30*d* in the light emission plane of the at least one additional light source 3*c*, 3*d* can, for example, take the form of horizontal strips extending transverse to the optical axis of the optical projection device 2/to the primary emission direction Z, and spaced apart from each other, preferably equidistantly, in the vertical direction V. In this case it is appropriate for the screening element 4, 5 to have opaque regions 40, 50 corresponding to these strips (see FIGS. 5 and 6).

The light-emitting regions 30*c*, 30*d* are preferably arranged directly (for example 0-5 mm) downstream, for example on the first screening element 4, 5.

The first screening element 4, 5 is preferably arranged between the entry optical unit 21, adapted, for example as the above-cited micro-entry optical unit array, and the light-emitting regions 30*c*, 30*d*.

In addition, the first screening element 5 can be adapted so as to form the intermediate image for a dipped beam distribution from the light emitted by the at least one light source 1. Such a screening element can, for example, have a plurality of corresponding apertures.

The screening element 4, 5 is preferably mounted on the light exit side with regard to the entry optical units 21, on the side of the light guide panel 31*c*, 31*d* facing towards the at least one light source 1.

Furthermore, exactly two additional light sources 3*c*, 3*d* can be provided, wherein a first additional light source 3*c* supports at least the first screening element 4, 5, a second additional light source 3*d* supports the exit optical unit 22 (see FIGS. 14 and 15), and the first screening element 4, 5 is mounted in front of the light-emitting regions 30*c* of the first additional light source 3*c*.

The exit optical unit, in particular the micro-exit optical unit array, is preferably arranged, for example applied, in particular bonded with adhesive, on a side of the second additional light source 3*d* facing away from the at least one first light source 1.

Figure 14:
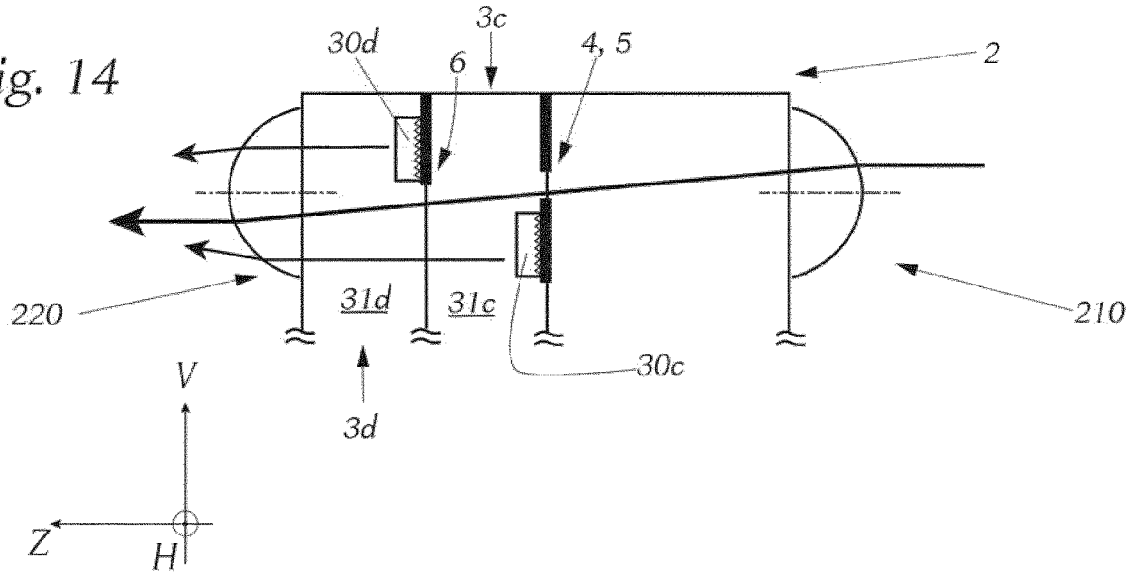
FIG. 14 and FIG. 15 show cross-sectional views of an enlarged part of a projection device of a motor vehicle light module in accordance with a second form of embodiment, with two additional light sources.
Figure 15:
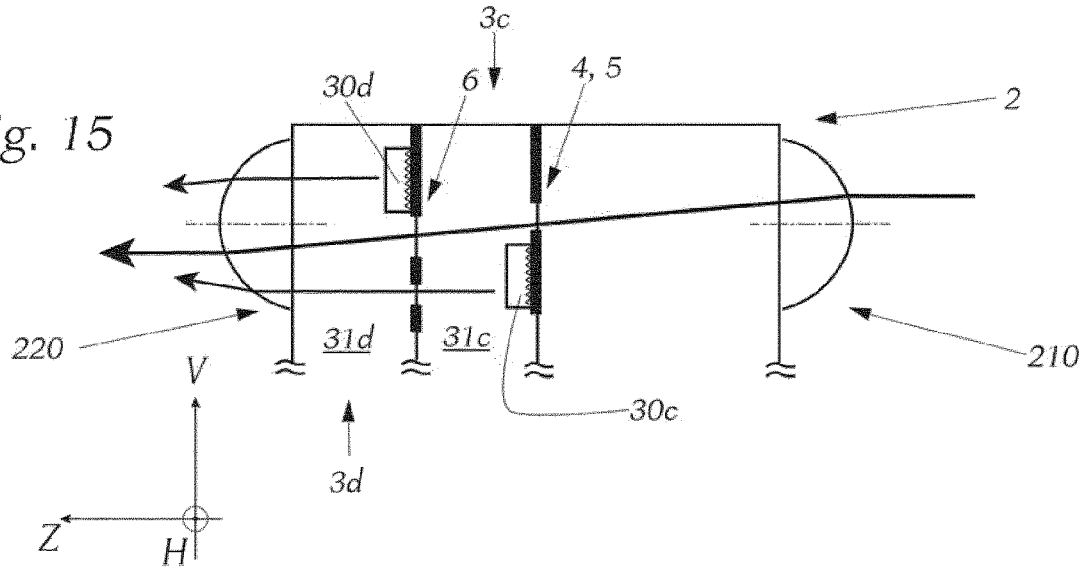

With reference to FIGS. 14 and 15, it can be said that the light-emitting regions 30*c* of the first additional light source 3*c* and the light-emitting regions 30*d* of the second additional light source 3*d* are adapted and positioned relative to each other such that light beams 300*c*, 300*d* generated by the corresponding light-emitting regions 30*c*, 30*d* propagate in different, non-intersecting regions of the projection device 2. The light-emitting regions 30*c* of the first additional light source 3*c* can, for example, be located in a lower region of the corresponding micro-optical systems, and the light-emitting regions 30*d* of the second additional light source 3*d* in an upper region of the micro-optical systems. Here it can be appropriate if all light-emitting regions 30*c* and 30*d* are located external to the first beam path 100.

In addition, a second screening element 6 can be provided, irrespective of the number of additional light sources 3*c*, 3*d*. The second screening element 6 can, for example, limit and/or collimate light emitted by the first additional light source 3*c* (see e.g. FIGS. 13 and 15). Furthermore, the second screening element 6 can be mounted in front of the light-emitting regions 30*d* of the second additional light source 3*d*. Here it is advantageous if the second screening element is adapted so as to shield the second additional light source 3*d*.

It should be noted at this point that the first screening element 4, 5 and the second screening element 6, similar to the screening device 7, 8 cited with regard to the first preferred form of embodiment, can be additionally adapted so as to shape the intermediate image, to create, for example, a dipped beam distribution with an asymmetrical cut-off line, and/or to correct optical aberrations (FIGS. 12 to 15). The first screening element 4, 5 and the second 6 can be adapted as a plane screen with a plurality of apertures.

FIGS. 12 to 15 show cross-sectional views of an enlarged part of a projection device of a motor vehicle light module in accordance with a second form of embodiment, with different numbers of screening elements 4, 5, 6 and additional light sources 30*c*, 30*d*. As can be seen below, in this preferred form of embodiment, the at least one additional light source can replace the shutter substrate or the substrate panel for the micro-exit optical unit array—the micro-exit optical unit array substrate panel.

From FIGS. 12 to 15 it can be seen that the light-emitting regions 30*c* and 30*d* emit collimated light 300*c*, 300*d*, preferably parallel to the optical axis of the projection device 2. The light-emitting regions 30*c* and 30*d* are dimensioned and positioned such that light beams 300*c* emitted from the first light-emitting regions 30*c* run parallel to, for example above (FIGS. 14 and 15), light beams 300*d* emitted from the second light-emitting regions 30*d*. If the first light-emitting regions 30*c* (the light-emitting regions 30*c* of the first additional light source 3*c*) are here positioned below an optical axis of corresponding micro-exit optical units 220, or a corresponding micro-optical units system, the beams 300*c* are refracted by these micro-exit optical units 220 and imaged in a region above the horizon. In motor vehicle lighting technology, the horizon is often referred to as the "line H-H" or "HH-line". This is a line corresponding to the horizon on a measuring screen on which light distributions generated by light modules are measured in a motor vehicle lighting technology laboratory. Line H-H is a part of the measuring screen coordinate system, which is common in motor vehicle lighting technology. Line H-H is a horizontal line, which runs parallel to the roadway (in the laboratory this is an imaginary roadway) and passes through a point of intersection HV of the photometric beam axis from the centre of the light module with the measuring screen. The point HV is the origin of the measuring screen coordinate system.

If the second light-emitting regions 30*d* (the light-emitting regions 30*c* of the second additional light source 3*c*) are here positioned below an optical axis of a corresponding micro-exit optical unit 220, or a corresponding micro-optical system, the beams 300*d* are refracted by this micro-exit optical unit 220 and imaged in a region below the horizon. In this way, for example, a first additional light source 3*c* can be used to generate a light distribution emitted above the horizon—for example a sign light distribution—and a second additional light source 3*d* can be used to generate a light distribution lying below the horizon—for example a daytime running light, or a direction indicator light distribution. The light-emitting regions 30*c*, 30*d* are arranged, preferably directly, at or behind the corresponding opaque region of the corresponding (first or second) screening element 4, 5, 6.

In addition, provision can be made for the first additional light source 3*c* also to support the second screening element 6.

The second screening element 6 is preferably arranged, for example applied, in particular bonded with adhesive, on a side of the first additional light source 3*c*, preferably of the light guide panel 31*c*, 31*d*, facing away from the at least one first light source 1.

It is to be understood that an operational light module for a motor vehicle headlamp has other parts that are not explicitly cited in the context of the present invention. These other parts include (but are not limited to) heat sinks, support frames, mechanical and/or electrical actuators, covers, and so on, and so forth. For the sake of simplicity of the presentation, however, the description of these standard components of a light module is omitted here.

The reference numbers in the claims serve only to provide a better understanding of the present inventions, and in no case imply a limitation of the present inventions.

The invention claimed is:

1. A light module for a motor vehicle headlamp comprising:

at least one light source (1), and at least one projection device (2), wherein the projection device (2) has an entry optical unit (21) and an exit optical unit (22), wherein the entry optical unit (21) is adapted to form an intermediate image, from light emitted by the at least one light source (1), in an intermediate image plane which intermediate image plane is located between the entry optical unit (21) and the exit optical unit (22), and is arranged substantially transverse to an optical axis of the projection device (2), and the exit optical unit (22) is adapted to image the intermediate image in the form of a light distribution of a first predefined type in a region in front of the light module, wherein:

at least one additional light source (3*a*, 3*b*, 3*c*, 3*d*) is provided, which at least one additional light source (3*a*, 3*b*, 3*c*, 3*d*) is adapted to emit light between the entry optical unit (21) and the exit optical unit (22), and to generate an additional intermediate image in the intermediate image plane;

the exit optical unit (22) is adapted to image the additional intermediate image generated by the at least one additional light source (3*a*, 3*b*, 3*c*, 3*d*) in the region in front of the light module, in the form of a light distribution of a second predefined type; and the entry optical unit (21) and the at least one additional light source (3*a*, 3*b*, 3*c*, 3*d*) are adapted and associated with each other such that the additional intermediate image generated by the at least one additional light source (3*a*, 3*b*, 3*c*, 3*d*) does not overlap the intermediate image formed from the light emitted by the at least one light source (1) by means of the entry optical unit (21).

2. The light module according to claim 1, wherein the at least one additional light source (3*a*, 3*b*, 3*c*, 3*d*) is adapted to generate collimated light that is substantially parallel to the optical axis of the projection device (2).

3. The light module according to claim 1, wherein the entry optical unit (21) and the exit optical unit (22) are arranged as matrix-like arrays of micro-entry optical units (210) and micro-exit optical units (220)—a micro-entry optical unit array and a micro-exit optical unit array respectively—arranged in planes standing transverse to the optical axis of the optical projection device (2), wherein at least one micro-exit optical unit (220) corresponds to each micro-entry optical unit (210) such that they have a common optical axis and form a micro-optical system.

4. The light module according to claim 3, wherein the micro-entry optical unit array has a plurality of intermediate regions (211) associated with the light-emitting regions (30*a*, 30*b*), wherein the light-emitting regions (30*a*, 30*b*) are distributed in the light-emitting plane in a checkerboard pattern, and the intermediate regions (211) are distributed in the micro-entry optical unit array in a checkerboard pattern, such that the light-emitting regions (30*a*, 30*b*) are arranged downstream of the intermediate regions (211).

5. The light module according to claim 4, wherein the intermediate regions (211) are opaque, or a shielding element (23) is provided with opaque shielding regions (230) corresponding to the intermediate regions, which shielding element (23) shields the intermediate regions (211) from the light of the at least one light source (1).

6. The light module according to claim 4, wherein:

the at least one additional light source (3*a*) is adapted to support the entry optical unit (21) or for the exit optical unit (22), exactly two additional light sources (3*a*, 3*b*) are provided, and a first of the two additional light sources (3*a*) supports the entry optical unit (21) and a second of the two additional light sources (3*b*) supports the exit optical unit (22), in particular the light-emitting regions (30*a*) of the first additional light source (3*a*) and the light-emitting regions (30*b*) of the second additional light source (3*b*) are adapted and positioned relative to each other such that light beams (300*a*, 300*b*) generated by the corresponding light-emitting regions (30*a*, 30*b*) propagate in different, non-overlapping regions of the projection device (2).

7. The light module according to claim 4, wherein the projection device (2) has at least one screening device (7, 8) lying between the entry optical unit (21) and the exit optical unit (22), which at least one screening device (7, 8) has apertures (70) corresponding to the intermediate regions (211), and is adapted so as to form the intermediate image, and/or to correct optical aberrations.

8. The light module according to claim 4, wherein the intermediate regions (211) are of a planar design.

9. The light module according to claim 3, wherein exactly one micro-exit optical unit (220) corresponds to each micro-entry optical unit (210) and the common optical axis extends horizontally.

10. The light module according to claim 1, wherein the at least one additional light source (3*a*, 3*b*, 3*c*, 3*d*) comprises a plurality of light-emitting regions (30*a*, 30*b*, 30*c*, 30*d*), spaced apart from each other, for purposes of emitting the light between the entry optical unit (21) and the exit optical unit (22), which light-emitting regions (30*a*, 30*b*, 30*c*, 30*d*)

are arranged in a plane standing substantially transverse to the optical axis of the projection device (2), the plane being a light emission plane.

11. The light module according to claim 10, wherein the at least one additional light source (3*a*, 3*b*, 3*c*, 3*d*) has a light guide element (31*a*, 31*b*, 31*c*, 31*d*) and an illuminant (32) associated with the light guide element, preferably an LED illuminant, wherein:

the light-emitting regions (30*a*, 30*b*, 30*c*, 30*d*) are arranged in the light guide element (31*a*, 31*b*, 31*c*, 31*d*), the light guide element (31*a*, 31*b*, 31*c*, 31*d*) is adapted as a light guide panel arranged substantially transverse to the optical axis of the projection device (2), the light guide panel has at least one light incoupling surface (310*a*, 310*c*) for purposes of coupling in light of the illuminant (32), which light propagates in the light guide panel, and is emitted from the light guide panel in the light-emitting regions, and each light-emitting region (30*a*, 30*b*, 30*c*, 30*d*) comprises a plurality of light decoupling prisms.

12. The light module according to claim 10, wherein a first screening element (4, 5) is provided, which first screening element (4, 5) is mounted in front of the light-emitting regions (30*c*, 30*d*), and shields the light-emitting regions (30*c*, 30*d*) from the light of the at least one light source (1), and wherein the light-emitting regions (30*c*, 30*d*) in the light emission plane of the at least one additional light source (3*c*, 3*d*) take the form of horizontal strips extending transverse to the optical axis of the optical projection device (2) and spaced vertically from each other, and the screening element (4, 5) has opaque regions (40, 50) corresponding to these strips.

13. The light module according to claim 12, wherein:

exactly two additional light sources (3*c*, 3*d*) are provided, a first additional light source (3*c*) supports at least the first screening element (4, 5), a second additional light source (3*d*) supports the exit optical unit (22), and the first screening element (4, 5) is mounted in front of the light-emitting regions (30*c*) of the first additional light source (3*c*), and the light-emitting regions (30*c*) of the first additional light source (3*c*) and the light-emitting regions (30*d*) of the second additional light source (3*d*) are adapted and positioned relative to each other such that light beams (300*c*, 300*d*) generated by the corresponding light-emitting regions (30*c*, 30*d*) propagate in different, non-intersecting regions of the projection device (2).

14. The light module according to claim 13, wherein a second screening element (6) is provided, which second screening element (6) is mounted in front of the light-emitting regions (30*d*) of the second additional light source (3*d*), and is adapted so as to shield the second additional light source (3*d*), and/or to limit light emitted by the first additional light source (3*c*).

15. The light module according to claim 12, wherein the horizontal strips are spaced vertically from each other equidistantly.

16. The light module according to claim 1, wherein:

the light distribution of a first predefined type is a primary light distribution, which is a dipped beam distribution or a main beam distribution, and the light distribution of a second predefined type is a secondary light distribution, which is selected from:

a static or dynamic direction indicator light distribution, emitted in the form of a running light;

a position light distribution;

a daytime running light distribution, which can be generated at least partially in the form of a running light;

a light distribution which forms one or a plurality of identical or different logos; and a welcome light function light distribution.

17. The light module according to claim 16, wherein the primary light distribution is an adaptive main beam distribution.

18. The light module according to claim 16, wherein the primary light distribution and the secondary light distribution are configured to be emitted simultaneously.

19. A motor vehicle headlamp with at least one light module according to claim 1.

* * * * *